United States Patent [19]

Arieh et al.

[11] Patent Number: 5,052,644

[45] Date of Patent: Oct. 1, 1991

[54] CLAMP

[76] Inventors: Simon Arieh, 24, Av. Gare des Eaux-Vives, 1208 Geneva; Guy Courvoisier, 48A, Route des Coudres, 1298-Celigny, both of Switzerland

[21] Appl. No.: 403,349

[22] Filed: Sep. 6, 1989

[30] Foreign Application Priority Data

Sep. 7, 1988 [CH] Switzerland ..... 357/88

[51] Int. Cl.[5] ..... A47F 7/00

[52] U.S. Cl. ..... 248/114; 24/538; 248/115; 248/231.8

[58] Field of Search ..... 248/114, 115, 116, 231.5, 248/231.8, 231.3, 316.2, 316.7; 24/538, 3 J, 3 L; 224/164, 165, 166; 368/278, 88, 10

[56] References Cited

U.S. PATENT DOCUMENTS

| | | | |
|---|---|---|---|
| 1,285,016 | 11/1918 | Maire-Brunel | 248/116 X |
| 1,501,000 | 7/1924 | Lane | 24/538 X |
| 2,229,978 | 1/1941 | Kolberg | 224/164 X |
| 2,560,929 | 7/1951 | Calbeck | 24/538 X |
| 3,561,077 | 2/1971 | Grant | 248/316.7 X |
| 3,755,860 | 9/1973 | Schenk et al. | 24/538 |
| 4,660,793 | 4/1987 | Mark | 248/231.8 |
| 4,673,153 | 6/1987 | Hilty et al. | 248/231.8 |
| 4,705,408 | 11/1987 | Jordi | 248/114 X |
| 4,736,921 | 4/1988 | Zane et al. | 248/316.2 |
| 4,780,934 | 11/1988 | Vickers et al. | 24/3 J |

FOREIGN PATENT DOCUMENTS

| | | | |
|---|---|---|---|
| 0079733 | 4/1919 | Switzerland | 248/115 |

*Primary Examiner*—Carl D. Friedman
*Assistant Examiner*—Daniel Hulseberg
*Attorney, Agent, or Firm*—Kane, Dalsimer, Sullivan, Kurucz, Levy, Eisele and Richard

[57] ABSTRACT

The clamp is of the type which may be actuated by means of an auxiliary actuating member. It consists of two parts, namely a clip (1), whose two branches are connected via a thin part (7) and a slit housing (8) in which an actuating member (2), consisting of a pin with a diameter greater than the diameter of the housing (8) or a cam equipped with a radial arm, is accommodated. The introduction of the pin or, respectively, the rotation of the cam results in closure of the clip, causing the thin part (7) to bend resiliently.

10 Claims, 2 Drawing Sheets

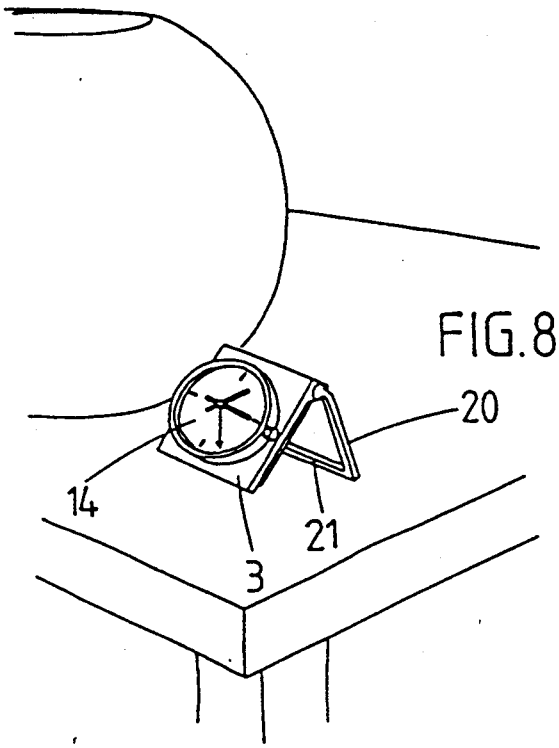
FIG.8
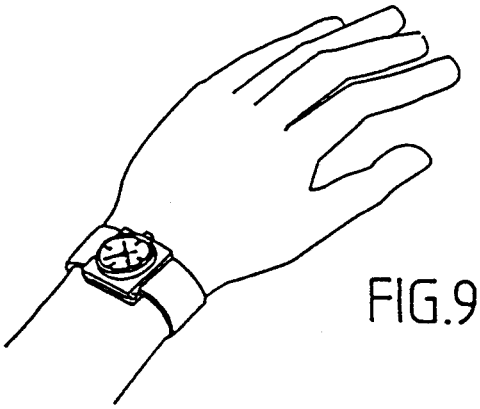
FIG.9
FIG.10
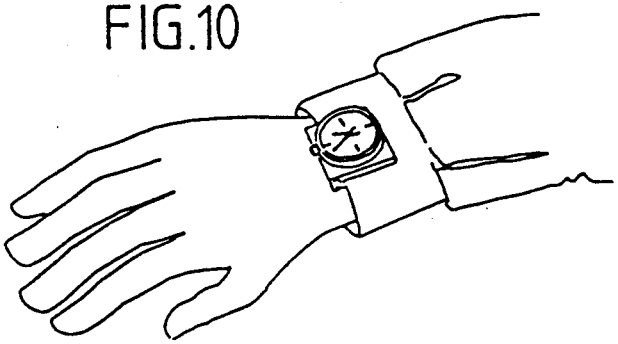

CLAMP

FIELD OF THE INVENTION

The subject of the present invention is a clamp consisting of a clip and an actuating member for closing the clip by separating the two parts of the clip against the action of a resilient means.

PRIOR ART

A clamp of this type is known from Patent CH 631,520. This clamp consists of a clip in two parts articulated and held open by the action of a spring catch. The clip may be closed by a cam secured to a lever. In the closed position of the clip, the lever actuating the cam is located in the extension of the clip, because the clamp is intended to be mounted on suspenders or on belts, or to hang clothing or paper. The manufacture of a clamp of this type requires the assembly of the clip and of the spring, operations which are not readily performed automatically and which have a considerable effect on the cost price of a clamp of this type.

SUMMARY OF THE INVENTION

The aim of the present invention is to produce a clamp of the same type, but of substantially simpler manufacture and which, in particular, does not comprise a spring.

The clamp according to the invention is defined in that the clip and the resilient means are made in a single piece, having two clip branches connected at their base by a thin part forming a resilient hinge and, on the other side of this thin part, a cylindrical housing, of circular section or otherwise, parallel to the thin part, open laterally along a generatrix opposite said thin wall, and intended to receive the member for actuating the clip.

The clamp according to the invention therefore comprises only two, the clip and the actuating member.

The actuating member may be a simple pin or a cam securely attached to a radial arm for its rotary movement.

The clamp according to the invention may not only be used for holding flat, thin objects together, but also as a support for an object intended to be fastened temporarily to another object. In particular, the clamp may be equipped with a watch which may thus be fastened rapidly and in a detachable manner on an article of clothing, a bracelet or the like. In the event that the clamp comprises a cam equipped with an actuating arm, this arm may act as a support for the clamp, enabling the watch to be placed in an oblique position on a table.

BRIEF DESCRIPTION OF THE DRAWINGS

The appended drawing shows, by way of example, two embodiments of the invention.

FIG. 8 shows the clamp of FIG. 4 equipped with a watch and placed on a table.

FIG. 9 shows the same clamp fastened to a bracelet.

FIG. 10 shows the same clamp fixed to a shirt cuff.

DESCRIPTION OF THE PREFERRED EMBODIMENTS

Figure 1:
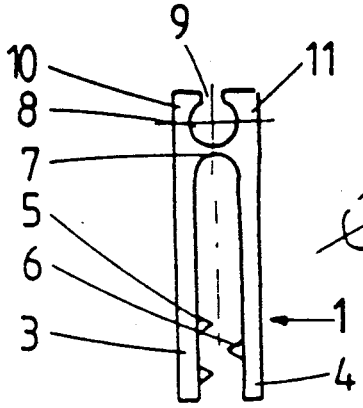
FIG. 1 shows the clip in profile and, separately, its actuating member in perspective, according to a first embodiment.
Figure 1:
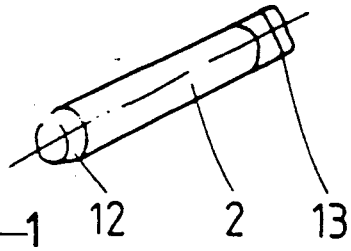

The clamp shown in FIG. 1 consists of a clip 1 and an actuating member 2.

Figure 2:
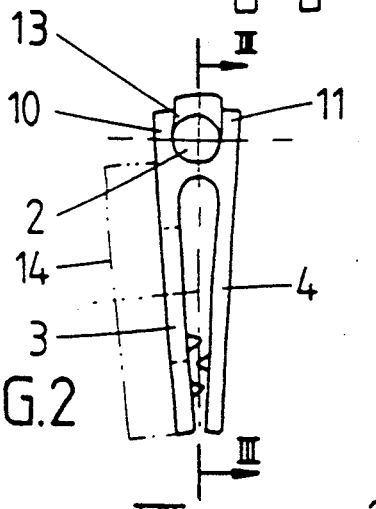
FIG. 2 shows the clamp in the closed position.
Figure 3:
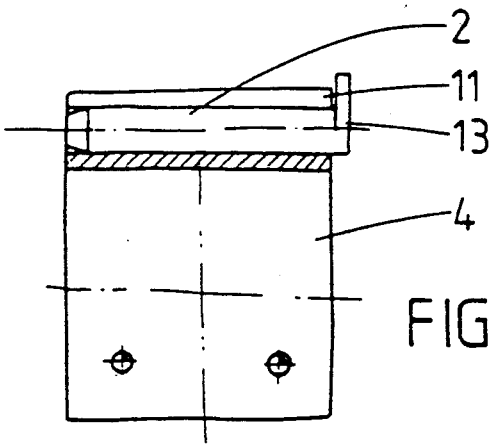
FIG. 3 is a section view along III—III of FIG. 2.

The clip 1 is made in a single piece from injection-molded synthetic material, such as nylon (registered trademark) or polyester or polyamide with a fiber filler. It has two clip arms 3 and 4 which are parallel and equipped on their opposing faces with projections 5 and 6. The two arms 3 and 4 of the clip are connected at their base by a relatively thin part 7 which can bend resiliently. On the other side of this thin part 7, the clip has a cylindrical housing 8 extending parallel to the part 7 and open laterally along a slit 9 extending along a generatrix opposite the part 7. The cylindrical housing 8 is thus itself limited by two arms 10 and 11. The actuating member 2 consists, in this first embodiment, of a cylindrical pin equipped with a frustoconical end 12 and a short radial arm 13 at the other end. The diameter of the pin 2 is slightly greater than the diameter of the cylindrical housing 8 of the clip. In order to tighten the clip, the pin 2 is forced into the housing 8. Because its diameter is greater than the diameter of the housing 8, the pin 2 separates the two arms 10 and 11 limiting the housing 8, which results in the arms 3 and 4 of the clip moving closer together, as represented in FIG. 2. In order to open the clamp, the pin 2 is removed via its arm 13. The clamp may act as a support for an object, for example a watch 14, whose outline has been represented in dot-dash lines in FIG. 2.

Figure 4:
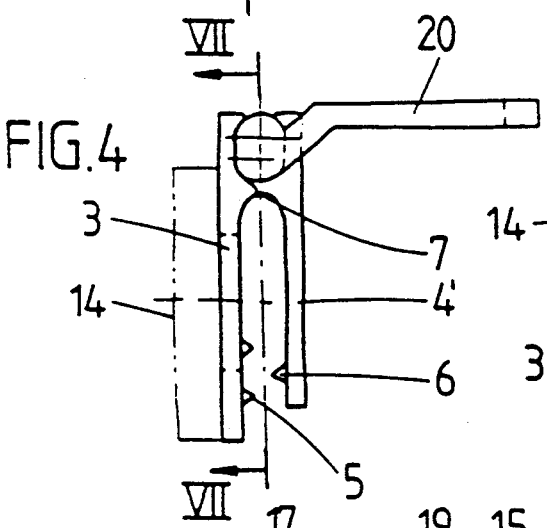
FIG. 4 is a profile view of a second embodiment of the clamp in the open position.
Figure 5:
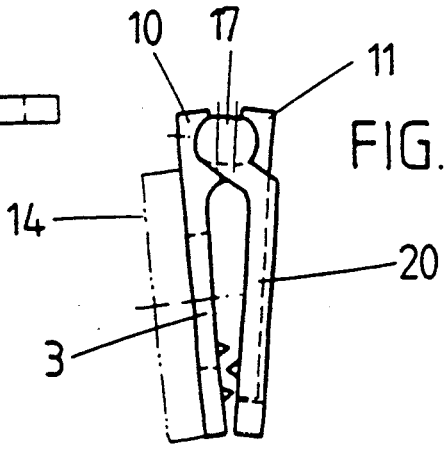
FIG. 5 shows the same clamp in the closed position.
Figure 6:
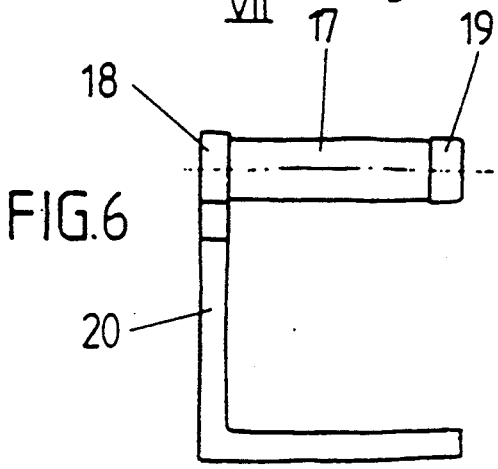
FIG. 6 shows the cam and its arm for closing the clamp shown in FIGS. 4 and 5.
Figure 7:
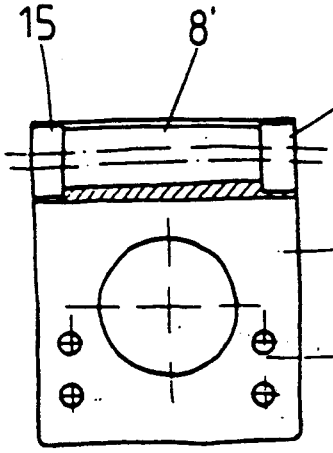
FIG. 7 is a sectional view along VII—VII of FIG. 4, without the actuating cam.

The second embodiment represented in FIGS. 4 to 7 comprises a clip which is virtually identical to the clip 1 of the first embodiment. It differs therefrom by a branch 4' which is shorter than the branch 3 and by a housing 8' with an oval section. Moreover, the ends 15 and 16 of the cylindrical housing 8, have a section which is larger than the rest of the housing. The member for actuating the clip consists of a cam 17 in the form of a cylinder of oval section approximately identical to that of the housing 8' and whose ends 18 and 19 have slightly larger sections and are housed in the ends 15 and 16 of the housing 8 so as to lock the cam 17 axially in the housing 8'. The cam 17 is equipped with a radial arm 20 having a bent part 21 extending parallel to the cam 17. When the arm 20 is directed perpendicularly to the clip, as represented in FIG. 4, the oval sections of the cam 17 and of the housing 8' of the clip coincide such that the clamp is opened. When the arm 20 is folded back parallel to the clip, the cam 17 separates the arms 10 and 11 of the housing 8', which results in closing of the clip, as represented in FIG. 5.

This clamp may also carry an object, for example a watch 14. In this case, the arm 20 may also be used as a support for holding the watch in an oblique position, placed on a table as represented in FIG. 8.

The clamp according to the first or second embodiment, equipped with a watch, may be fastened on any flat object or flat part of an object having a suitable thickness. Thus, the watch may be clipped onto an article of clothing, for example on a pocket, on a shirt or on a jacket lapel. It may also be fastened on a key ring equipped with a fob or on a cord in order to be carried around the neck, for example. It may, in particular, be carried on a bracelet, as represented in FIG. 9, turning it into a wrist watch, or on the cuff of a shirt, as represented in FIG. 10, which turns it into a strapless wrist watch. The very small part projecting laterally from the bracelet or the cuff, respectively, will be noted.

The clamp according to the invention, equipped with a watch or otherwise, may, of course, be used quite simply as a clamp for holding sheets of paper together, for example bank bills.

By means of two clamps according to the invention connected by a cord, it is possible to produce a security device for fastening a pocketbook or a wallet. One of the clamps is fastened to the article of clothing and the other to the pocketbook or wallet, respectively.

Of course, the clamp may carry any other object of suitable size, such as a compass, medal, photoframe, and the like.

The clamp could be produced in metal, particularly by injection of an aluminum alloy.

The section of the actuating cam and the section of the housing for this cam do not need to be oval.

It should be emphasized that the word "cylindrical" is taken in its widest geometrical sense, it being possible for the section of the cylinder to be circular or otherwise.

We claim:

1. A clamp consisting of a clip and an actuating member for closing the clip, working by separation of two parts of the clip against the action of a resilient means, wherein the clip and the resilient means are made in a single piece (1), having two clip branches (3, 4) connected at their base by a thin part (7) forming a resilient hinge and, on the other side of this thin part, a cylindrical housing of circular section or otherwise (8), parallel to the thin part, open laterally along a generatrix opposite said thin part, and intended to receive the member (2, 17) for actuating the clip; said actuating member having at least in one lateral direction a dimension greater than the diameter of the cylindrical housing for actuating the clamp and being rotatable within said cylindrical housing, wherein said rotation of said actuating member causing the clamp to actuate.

2. The clamp as claimed in claim 1, wherein said housing (8') has an oval section and wherein the member for actuating the clip is a cylindrical cam with an oval section (17) housed in the housing of the clip and securely attached to an actuating arm (20).

3. The clamp as claimed in claim 2, wherein the arm (20) is capable of being in an open position and a closed position, when said clip is in the open position it forms an angle of between 45° and 135° with the clip and wherein it is parallel to the clip in the closed position of the clip.

4. The clamp according to claim 1, wherein it constitutes a support for an object of suitable size.

5. The clamp as claimed in claim 4, wherein one of the branches of the clip carries a watch.

6. The clamp as claimed in claim 3, wherein one of the branches of the clip carries a watch and wherein the actuating arm of the cylindrical cam is bent (21) parallel to said housing.

7. A clamp consisting of a clip and an actuating member for closing the clip, working by separation of two parts of the clip against the action of a resilient means, wherein the clip and the resilient means are made in a single piece, having two clip branches connected at their base by a thin part forming a resilient hinge and, on the other side of this thin part, a cylindrical housing, of circular section or otherwise, parallel to the thin part, open laterally along a generatrix opposite said thin part, and intended to receive the member for actuating the clip wherein said housing has an oval section and wherein the member for actuating the clip is a cylindrical cam with an oval section housed in the housing of the clip and securely attached to an actuating arm wherein the arm is capable of being in an open position and a closed position, when said clip is in the open position it form an angle of between 45° and 135° with the clip and wherein it is parallel to the clip in the closed position of the clip.

8. The clamp as claimed in claim 7, wherein one of the branches of the clip carries a watch and wherein the actuating arm of the cylindrical cam is bent parallel to said housing.

9. A clamp consisting of a clip and an actuating member for closing the clip, working by separation of two parts of the clip against the action of a resilient means, wherein the clip and the resilient means are made in a single piece (1), having two clip branches (3, 4) connected at their base by a thin part (7) forming a resilient hinge and, on the other side of this thin part, a cylindrical housing, of circular section or otherwise (8), parallel to the thin part, open laterally along a generatrix opposite said thin part, and intended to receive the member (2, 17) for actuating the clip, said housing (8') has an oval section and wherein the member for actuating the clip is a cylindrical cam with an oval section (17) housed in the housing of the clip and securely attached to an actuating arm (20), and wherein the arm (20) is capable of being in an open position and a closed position and when said clip is in the open position it forms an angle of between 45° and 135° with the clip and is parallel to the clip in the closed position of the clip.

10. The clamp as claimed in claim 9, wherein one of the branches of the clip carries a watch and wherein the actuating arm of the cylindrical cam is bent (21) parallel to said housing.

* * * * *

UNITED STATES PATENT AND TRADEMARK OFFICE

CERTIFICATE OF CORRECTION

PATENT NO. : 5,052,644

DATED : Oct. 1, 1991

INVENTOR(S) : Simon Arieh et al.

It is certified that error appears in the above-identified patent and that said Letters Patent is hereby corrected as shown below:

On the title page:

Item [30] Foreign Application Priority Data should read --Switzerland 3357/88--.

Signed and Sealed this

Eighth Day of June, 1993

*Attest:*

*Attesting Officer*

Michael K. Kirk

MICHAEL K. KIRK

*Acting Commissioner of Patents and Trademarks*